United States Patent [19]

Atherton et al.

[11] Patent Number: 4,741,840

[45] Date of Patent: May 3, 1988

[54] PROCESS FOR TREATING A SLUDGE CONTAINING HYDROCARBONS

[75] Inventors: George A. Atherton, Baton Rouge, La.; Ghazi A. Dickakian, Greenville, S.C.; Edward D. Grant, Jr., Baton Rouge, La.

[73] Assignee: Exxon Research & Engineering Co., Florham Park, N.J.

[21] Appl. No.: 878,122

[22] Filed: Jun. 25, 1986

Related U.S. Application Data

[63] Continuation of Ser. No. 453,344, Dec. 27, 1982, abandoned, which is a continuation-in-part of Ser. No. 333,989, Dec. 23, 1981, Pat. No. 4,686,048.

[51] Int. Cl.[4] ..... B01D 37/02

[52] U.S. Cl. ..... 210/771; 210/778; 210/806

[58] Field of Search ..... 210/771, 772, 778, 806; 134/40; 208/13

[56] References Cited

U.S. PATENT DOCUMENTS

| | | | |
|---|---|---|---|
| 3,692,668 | 9/1972 | McCoy et al. | 210/18 |
| 3,696,021 | 10/1972 | Cole et al. | 208/13 |
| 4,260,484 | 4/1981 | Greig et al. | 210/771 |
| 4,264,453 | 4/1981 | Mraovich | 210/774 |

*Primary Examiner*—Frank Spear

*Attorney, Agent, or Firm*—J. J. Mahon; S. H. Markowitz

[57] ABSTRACT

A process is disclosed for treating sludge to remove the liquid hydrocarbons from the insoluble particles in the sludge to provide treated particles which are environmentally safe. The process involves mixing the sludge with a hydrocarbon diluent, separating the particles from the diluent-sludge mixture, then mixing the separated particles and remaining diluent with water and distilling off the remaining diluent to obtain the treated particles.

13 Claims, No Drawings

PROCESS FOR TREATING A SLUDGE CONTAINING HYDROCARBONS

CROSS REFERENCE TO RELATED APPLICATIONS

This is a continuation of application Ser. No. 453,344, filed 12/27/82, which is a continuation in part of U.S. Ser. No. 333,989, filed 12-23-81; now U.S. Pat. No. 4,686,048.

A number of processes in petroleum production and refining and the chemicals industry produce as by-products sludges which contain liquid hydrocarbons and insoluble solid particles and may contain water. These sludges not only contain a large amount of useful hydrocarbons, but present difficult and expensive disposal problems.

Among the processes which produce sludges which contain liquid hydrocarbons are steam cracking, catalytic cracking and liquification of coal. Steam cracking produces a steam cracking tar which contains insoluble particles of coke generally at a level of 0.001 to 5 wt. % with the remainder being useful heavy liquid hydrocarbons. Catalytic cracking produces cat cracker bottoms which contains catalyst fines generally at a level of 0.1 to 5 wt. % with the remainder being useful heavy liquid hydrocarbons. Liquification of coal, such as by the donor solvent technique as described in U.S. Pat. Nos. 4,085,031, 4,253,937, 4,048,054 and 4,045,328, produces a solvent-coal slurry containing insoluble particles. Other liquids from coal may be produced by, for example, pyrolysis of coal. These liquid hydrocarbon streams contain insoluble particles which are desirably removed or reduced in level to allow for their use as a fuel oil or as a feedstock for producing other products.

The liquid hydrocarbon streams which contain the insoluble particles may be routed to a settling tank wherein the solid particles (catalyst fines, coke, inorganic matter, etc.) are allowed to settle by gravity with the upper layer of substantially particle-free liquid hydrocarbons being decanted off for product use. Settling of the particles may also occur in intermediate or shipping tanks. Generally, the incoming hydrocarbon stream contains a solids level of about 0.1 to 5.0% by weight and the level of solids must be reduced by at least 75% or greater to a solids level of less than 0.05% by weight for subsequent product use of the liquid hydrocarbons. After settling, the resultant sludge containing the insoluble, solid particles and the liquid hydrocarbons will generally have a solids content on the order or 10 to 60% by weight and a hydrocarbon level on the order of 40 to 90% by weight.

Another method of reducing the level of solids in some liquid hydrocarbon streams is by dielectrophoretic separation, the resultant sludge having a solids level on the order or 2 to 5% by weight.

Past practice involved transporting the sludge to landfarms, landfills or other disposal treatments. The landfarm process consists of controlled application and cultivation of waste on soil, on a properly engineered site, in order to use microbes naturally present in the soil to decompose the organic fraction of waste. These past practices have been extremely time consuming and expensive, with the need being indentified for a more efficient and environmentally safe process to be developed.

U.S. Pat. No. 4,123,357 dicloses a process whereby oil, water, and the solids materials of the sludge are stirred at high temperatures of at least 95° F., followed by settling, decanting, settling and again decanting the upper layers which are substantially solid free. U.S. Pat. No. 4,206,001 dicloses circulating a solvent with the sludge in the rundown tank, followed by decanting the solvent, then washing the settled solids with water, followed again by decanting the aqueous solution and hydrocarbons. While these procedures are effective in reducing the level of hydrocarbons on the solids, an alternative process is desirable which can more effeciently remove the liquid hydrocarbons from the solid particles and which is less time consuming.

Other methods for processing a sludge include diluting or mixing the sludge with a light hydrocarbon solvent, subjecting the sludge to high temperatures and pressures and the like, but these are, in general, unattractive methods for reasons of economy, explosion hazards and the like.

Therefore, it is a feature of the present invention to provide a process which efficiently removes liquid hydrocarbons from sludge.

It is another feature of this invention to treat the insoluble particles in a sludge containing liquid hydrocarbons to provide an environmentally safe treated sludge.

It is still a further feature of this invention to recover and isolate the hydrocarbons from the sludge.

SUMMARY OF THE INVENTION

Briefly, the features of this invention are carried out by treating sludge to remove the liquid hydrocarbons from the insoluble particles (fines) in the sludge by mixing the sludge with a hydrocarbon diluent having a boiling point when mixed with water of less than 212° F.; separating the particles (solids) from the diluent-sludge mixture; mixing the separated particles and remaining hydrocarbon diluent with water; and removing the remaining hydrocarbon diluent by distillation to obtain the treated fines. Preferably the separating steps are carried out by filtration.

DETAILED DESCRIPTION OF THE INVENTION

Within the steam cracking reaction or the catalytic cracking reactor, the liquid hydrocarbon feedstock is subjected to processing conditions of elevated temperature and sometimes elevated pressure to accomplish the desired cracking. The resultant effluent of the reactor is then fractionated into the desired fractions of gases, light liquid hydrocarbons and heavy liquid hydrocarbons, with the heaviest and highest boiling fraction being the steam cracker tar or the cat cracker bottoms which contain the insoluble particles. The coal liquification process involves contacting particulate coal with a hydrogen (e.g. a hydrogen donor solvent) under liquification conditions producing a hydrocarbon stream containing insoluble particles. The hydrocarbon stream can be fractionated to produce gases, light liquid hydrocarbons and heavy liquid hydrocarbons with the heaviest fraction being the bottoms containing the particles. Other liquids from coal may be produced by pyrolysis of coal.

This invention broadly treats any liquid hydrocarbon stream containing insoluble solids or particles and liquid hydrocarbons to remove or substantially reduce the hydrocarbon level and provide a treated insoluble particle which is cleaner (less hydrocarbons) and thus easier to dispose of. The term solids, particles or fines as used herein includes various insoluble solids such as coke, catalyst fines, etc. which may be in a liquid hydrocarbon stream or sludge.

The particles in the hydrocarbon stream are concentrated to produce the sludge. One method of concentrating the particles in the sludge is by settling the fines through the action of gravity and drawing off the upper (top-most) layer which contains the hydrocarbons which are relatively free of solid particles (fines). In general, the resultant sludge (lower layer) has a solids content within the range of 10% to 60% by weight, and a hydrocarbon content of 40% to 90% by weight, however, lower solids contents could also be effectively obtained by this process. An alternative method of concentrating the particles (solids) in some sludges is dielectrophoretic separation of the solids. In general, the dielectrophoretic separation results in a solids content in the sludge of about 2 to 5% by weight. The process of this invention for treating sludge to remove the hydrocarbons from the particles in the sludge can process sludge having a widely varying solids content, generally on the order of 1 to 60% by weight, preferably on the order of 10 to 55% by weight of the sludge.

The first step of the process of this invention involves mixing the sludge with a hydrocarbon diluent. This diluent critically should have a boiling point when combined with water of less that 212° F., i.e. either its boiling point is less than 212° F., or its azeotropic boiling point when combined with water is less than 212° F. The choice of this hydrocarbon diluent is critical to the subsequent economical and substantial removal of hydrocarbons from the particles in the sludge. Generally, this diluent should be compatible with the hydrocarbons in the sludge in the relative volumes used and able to dilute the same for subsequent separation of the liquid hydrocarbons from the particles. Generally, the diluent will be a liquid light hydrocarbon having a carbon content of C7 or less. The diluent preferably has a boiling point when combined with water of 150° F. to 212° F. The above boiling point temperatures are interdependent with a process operating at atmospheric pressure. Higher or lower pressures could be utilized with the boiling point temperatures being adjusted accordingly. Preferred diluents which azeotropically distill with water include heptane (azeotropic boiling point of about 182° F.), benzene (azeotropic boiling point of 156° F.) and toluene (azeotropic boiling point of 183° F.). Other diluents include n-hexane, methylhexane, ethylpentane, dimethylpentane, trimethybutane, hexene, heptene, methylcyclopentane, cyclohexane, dimethylcyclopentane and methylcyclopentadiene, with the preferred classes being pentane, hexane, and heptane. Blends of the above diluents may also be employed.

The sludge is mixed with an amount of diluent effective to dilute the hydrocarbons and effectively withdraw the hydrocarbons upon subsequent separation. Generally, the amount of diluent is within the range of 50% to 500% by weight, preferably 50% to 150% by weight of the hydrocarbons in the sludge. The sludge and diluent are mixed at a temperature below the boiling point of the diluent, preferably within the range of 100° F. to 210° F. to maintain the sludge flowable. If water is present in the sludge (e.g., greater than about 2% by weight of the sludge), it is desirable to substantially remove the water to enable the fines to be subsequently separated. This may be carried out by providing sufficient heat to the sludge-diluent mixture to remove (distill) the water present, i.e., as a diluent (e.g., heptane) water azeotrope.

The next step involves separating the fines from the diluent-sludge mixture. This separation may be carried out by a number of means including the use of centrifuges, settling tanks or cyclones, but preferably the separation is carried out by filtration. At this stage, it is preferably to wash the cake (separated fines) with additional diluent to effectively remove the liquid hydrocarbons remaining in the cake (separated fines). The amount of additional diluent is generally within the range of 20% to 500% by weight of the hydrocarbons in the original sludge. Additionally, gas such as nitrogen may be forced through the cake to force off excess diluent. A separation aid may be added to the diluent-sludge mixture to accelerate the separation of the fines. For example, a filtration aid such as diatomaceous silica, aluminum alkali silicate, fuller's earth, magnesia or cellulose fiber may be added. The liquid fraction separated from the fines contains the liquid hydrocarbons and diluent.

The separated fines and remaining diluent (cake) are then mixed with water. The separated fines and remaining diluent can be mixed with liquid water to form a slurry, with the amount of water being generally within the range of 100% to 1500% by weight, preferably 250% to 700% by weight of the separated fines and remaining diluent (cake). The mixing of the slurry is carried out at a temperature below the boiling point of the diluent when combined with water, preferably within the temperature range of ambient to 210° F. An antifoaming agent such as a high molecular weight polyhydric alcohol, polyamide, silicone, organic phosphate or aliphatic ester may be added to the slurry to prevent foaming of the slurry during distillation. Alternatively, the separated fines and remaining diluent can be mixed with water in the form of steam (preferably on the filter itself0, which beneficially additionally provides the energy needed to distill off the remaining diluent while adding liquid water to the fines by condensation of the steam. The amount of steam is generally within the range of 3% to 50%, preferably 8% to 25%, by weight of the separated fines and remaining diluent (cake).

The separated fines, remaining diluent and water are subjected to distillation to remove the remaining hydrocarbon diluent. This distillation step is critical for effectively reducing the hydrocarbon content (which includes the diluent) remaining in the separated fines. While some hydrocarbons will azeotropically distill (water and diluent distill as one phase and at one temperature), other diluents will be effectively distilled off as they boil at a temperature lower than the water (i.e. lower than 212° F.). Through this distillation the diluent can be effectively removed from the fines, with the resultant hydrocarbon content of the treated fines being generally less than 20% by weight and preferably less than 5% by weight. Advantageously this distillation can effectively remove the water and diluent at low temperatures, i.e. 212° F. or less, thus avoiding expensive and dangerous heating of the fines, diluent and hydrocarbons.

Following distillation when there is excess water the fines are then separated out. This separation can also be carried out by any one of a number of processes including settling tanks, centrifuges and cyclones, but the preferable separation is carried out by filtration.

The resultant cake of treated fines in general has a solids content of at least about 50% by weight, a hydrocarbon content of up to about 20% by weight and a water content of up to 40% by weight and wherein at least 75% by weight of the liquid hydrocarbons have been removed from the sludge. Preferably, the resultant cake of treated fines has a solids content of at least about 55% by weight, a hydrocarbon content of up to 5% by weight, and a water content of up to 35% by weight and wherein at least 95% by weight of the liquid hydrocarbons have been removed from the sludge. These treated fines can then be economically and environmentally safely disposed of as by landfilling, or if catalyst fines are involved they may even be recycled to the cat cracking reactor, or if the fines are coke they may be subsequently burned as fuel.

The various liquid fractions, removed upon separation and distillation, are then processed to recover and isolate from each other the water, the diluent, and the liquid hydrocarbons. The isolation of the liquid components can be carried out by any one of a number of known procedures. The aqueous solution-diluent fraction can be decanted to separate the diluent from the water. The diluent liquid hydrocarbon fraction can be fractionated to remove the diluent from the liquid hydrocarbons. The diluent and water may then be recycled to provide an economically sound process and the liquid hydrocarbons may be blended into a fuel, or used as a feedstock for producing various products.

EXAMPLE I

Cat cracker bottoms from a cat cracking operation are fed into a settling tank to settle the solids (catalyst fines) into a sludge containing 20% by weight ash and 80% by weight cat cracker bottoms.

The sludge is mixed with heptane (boiling point of about 209° F.) at a 1:1 by weight ratio of heptane to cat cracker bottoms in the sludge, with mixing being carried out for two hours at 190° F. in a mixing tank. The mixture is then filtered hot to separate fines (cake), followed by washing the separated fines (cake) with heptane at 190° F. at a by weight ration of 0.5:1 of heptane to cat cracker bottoms in the original sludge. The free heptane is then drained off the cake.

The separated fines and remaining heptane (cake) are sluiced off the filter with water into a slurry tank forming a slurry containing a by weight ratio of 3.5:1 of water to separated fines and remaining heptane (cake). The remaining heptane is removed by boiling (distilling) off the heptane-water azeotrope which has a boiling point of about 182° F. The resultant fines-water slurry is filtered, with water being recycled.

The treated fines then are disposed by landfilling, with the treated fines containing by weight about 71% catalyst fines, about 27% water and about 2% hydrocarbons, and wherein greater than 99% of the cat cracker bottoms hydrocarbons are removed from the sludge. The heptane and the cat cracker bottoms hydrocarbons are recovered and isolated from each other in a steam stripper tower with reboiler, with the heptane and water streams being isolated from each other by decanting. Subsequently the water and heptane are recycled into the process, with the cat cracker bottoms hydrocarbons being used in other products.

EXAMPLE II

Cat cracker bottoms from a cat cracking operation are fed into a settling tank to settle the solids (catalyst fines) into a sludge containing 20% by weight ash and 80% by weight cat cracker bottoms.

The sludge is mixed with heptane (boiling point of about 209° F.) at a 1:1 by weight ratio of heptane to cat cracker bottoms in the sludge, with mixing being carried out for two hours at 190° F. in a mixing tank. The mixture is then filtered hot to separate the fines (cake), followed by washing the separated fines (cake) with heptane at 190° F. at a by weight ratio of 0.5:1 of heptane to cat cracker bottoms in the original sludge. The free heptane is then drained off the cake.

Steam is then introduced through the separated fines and remaining heptane (cake) at a by weight ratio of about 1.5:10 of steam to separated fines and remaining heptane (cake), which heats the fines at the same time water is added to the fines by condensation of the steam. The heat imparted by the steam distills off the remaining heptane as a heptane-water azeotrope which has a boiling point of about 182° F.

The treated fines then are disposed by landfilling, with the treated fines containing by weight greater than about 80% catalyst fines, less than about 20% water and less than about 1% hydrocarbons, and wherein greater than 99% of the cat cracker bottoms hydrocarbons are removed from the sludge. The heptane and the cat cracker bottoms hydrocarbons are recovered and isolated from each other in a steam stripper tower with reboiler, with the heptane and water streams being isolated from each other by decanting. Subsequently, the water and heptane are recycled into the process, with the cat cracker bottoms hydrocarbons being used in other products.

EXAMPLE III

Steam cracker tar from the steam cracking operation are fed into a settling tank to settle the solids (coke particles) into a sludge containing about 50% by weight coke and 50% by weight steam cracker tar hydrocarbons.

The sludge is mixed with heptane at a 4:1 by weight ratio of heptane to sludge with mixing at 190° F. in a mixing tank. Over a period of one hour additional sludge is added to the mix, either continuously or in increments, so that at the end of one hour the ratio of heptane to sludge has reached 1:1. This is carried out to maintain the mixture at a viscosity which can be handled.

If water is present in the sludge, the temperature in the mix tank, which is equipped with a reflux condenser and a reflux decanter, is raised to the boiling temperature of the heptane/water azeotrope, approximately 182° F., and heptane with any water, as the azeotrope, is constantly taken overhead. The water is decanted and rejected and the heptane is returned to the mixing tank. As soon as the condensed overhead product is free of water, refluxing is discontinued.

The mixture is filtered hot to separate the coke fines (cake), followed by washing the separated coke fines (cake) with heptane at 190° F. at a by weight ratio of 1:1 of heptane to steam cracker tar in the original sludge.

Steam is then introduced through the separated fines and remaining heptane (cake) at a by weight ratio of about 1:10 of steam to separated fines and remaining heptane (cake), which heats the fines at the same time water is added to the fines by condensation of the steam. The heat imparted by the steam distills off the remaining heptane as a heptane-water azeotrope which has a boiling point of about 182° F.

The cake of treated coke fines then are disposed of by landfilling or burning in a furnace, with the cake of treated fines containing by weight about 53% coke fines, about 30% water and about 17% hydrocarbons, and wherein greater than about 80% of the steam cracker tar hydrocarbons are removed from the sludge. The heptane and steam cracker tar hydrocarbons are recovered and isolated from each other in a steam stripper tower with reboiler, with the heptane and water streams being isolated from each other by decanting. Subsequently, the water and heptane are recycled into the process, with the steam cracker tar hydrocarbons being used in other products.

What is claimed is:

1. A process for treating a steam cracker tar sludge containing liquid hydrocarbons and insoluble particles to remove the liquid hydrocarbons from the particles in the sludge which comprise:

mixing the sludge with heptane which has a boiling point when combined with water of about 182° F. in an amount of 50% to 150% by weight of hydrocarbons in the sludge and mixing the heptane and the sludge within the range of 100° F. to 210° F. to maintain the sludge flowable and heating the sludge to remove any water present as a heptane/-water azeotrope;

separating the particles from the heptaneslude mixture by filtration and washing the particles with additional heptane in an amount of 20% to 500% by weight of the hydrocarbons in the original sludge;

mixing the separate particles and remaining heptane with water in an amount of 250% to 700% by weight of the separated fines and recovering heptane; and removing remaining heptane by distillation to obtain a cake of treated particles containing less than 20% by weight of hydrocarbons.

2. Process of claim 1 further comprising prior to mixing the sludge with heptane, concentrating the particles in the liquid hydrocarbons by settling the particles and drawing off particle-free liquid hydrocarbons.

3. Process of claim 2 wherein the sludge has a solids content of about 10% to 60% by weight and a liquid hydrocarbon content of about 40% to 90% by weight.

4. Process of claim 3 wherein the cake of treated particles has a solids content of at least about 50% by weight, a hydrocarbon content of up to 20% by weight, and a water content of up to about 40% by weight, and wherein at least 75% by weight of the liquid hydrocarbons are removed from the sludge.

5. Process of claim 1 further comprising separating the particles from the water slurry after distillation.

6. Process of claim 5 wherein the particles separated from the water slurry by filtration.

7. Process of claim 1 wherein the water is mixed with the particles at a temperature below the boiling point of the heptane when combined with water and within the range of ambient about 210° F.

8. Process of claim 1 wherein the water in the form of steam is mixed with the separated particles and remaining heptane.

9. Process of claim 8 wherein the amount of steam is within the range of 3 to 50% by weight of the separated particles and remaining heptane.

10. Process of claim 1 further comprising adding a separation aid to the heptane sludge mixture which accelerates separation of the fines.

11. Process of claim 1 further comprising adding an antifoaming agent to the slurry.

12. Process of claim 1 further comprising prior to mixing the sludge with the heptane, concentrating the particles in the sludge by dielectrophoretic separation.

13. Process of claim 1 further comprising recovering and isolating from each other the water, the heptane, and the liquid hydrocarbons which were separated and distilled from the particles.

* * * * *